US007506509B2

(12) United States Patent
Stock

(10) Patent No.: US 7,506,509 B2
(45) Date of Patent: Mar. 24, 2009

(54) SYSTEM FOR CONVERTING THERMAL TO MOTIVE ENERGY

(76) Inventor: Gerhard Stock, Friedenseiche 1, 56850 Enkirch (DE)

( * ) Notice: Subject to any disclaimer, the term of this patent is extended or adjusted under 35 U.S.C. 154(b) by 0 days.

(21) Appl. No.: 10/587,235

(22) PCT Filed: Jan. 13, 2005

(86) PCT No.: PCT/DE2005/000037

§ 371 (c)(1),
(2), (4) Date: Apr. 27, 2007

(87) PCT Pub. No.: WO2005/071232

PCT Pub. Date: Aug. 4, 2005

(65) Prior Publication Data

US 2008/0016867 A1 Jan. 24, 2008

(30) Foreign Application Priority Data

Jan. 24, 2004 (DE) ..... 10 2004 003 694

(51) Int. Cl.
*F01K 1/00* (2006.01)

(52) U.S. Cl. ..... 60/659; 60/613; 91/4 A

(58) Field of Classification Search ..... 60/645, 60/670, 413–418, 659; 91/4 R, 4 A
See application file for complete search history.

(56) References Cited

U.S. PATENT DOCUMENTS

| | | | | |
|---|---|---|---|---|
| 3,237,523 | A * | 3/1966 | Wallace | 91/4 A |
| 3,608,311 | A * | 9/1971 | Roesel, Jr. | 60/516 |
| 5,074,110 | A | 12/1991 | Singh et al. | |
| 5,647,734 | A * | 7/1997 | Milleron | 417/380 |
| 5,775,103 | A * | 7/1998 | Ingvast | 60/453 |
| 6,564,551 | B1 * | 5/2003 | Stock | 60/516 |

FOREIGN PATENT DOCUMENTS

| | | |
|---|---|---|
| EP | 0 043 879 | 1/1982 |
| EP | 1 159 512 | 12/2001 |

OTHER PUBLICATIONS

International Search Report for PCT/DE2005/000037 (3 pages).
English abstract of WO 00/053898.

* cited by examiner

*Primary Examiner*—Hoang M Nguyen
(74) *Attorney, Agent, or Firm*—Rader, Fishman & Grauer PLLC

(57) ABSTRACT

The invention relates to a system for converting thermal to motive energy. Said system comprises at least one pressure vessel, having at least one upper injection orifice for a warm and/or cold fluid, and at least one liquid piston pump inside the pressure vessel which is coupled with a working cycle. The pressure vessel has a horizontal partition that is provided with a bore. Above said partition, a gas or gas mixture is present, and below the partition, the liquid piston pump is located.

13 Claims, 3 Drawing Sheets

SYSTEM FOR CONVERTING THERMAL TO MOTIVE ENERGY

DESCRIPTION

Figure 1:
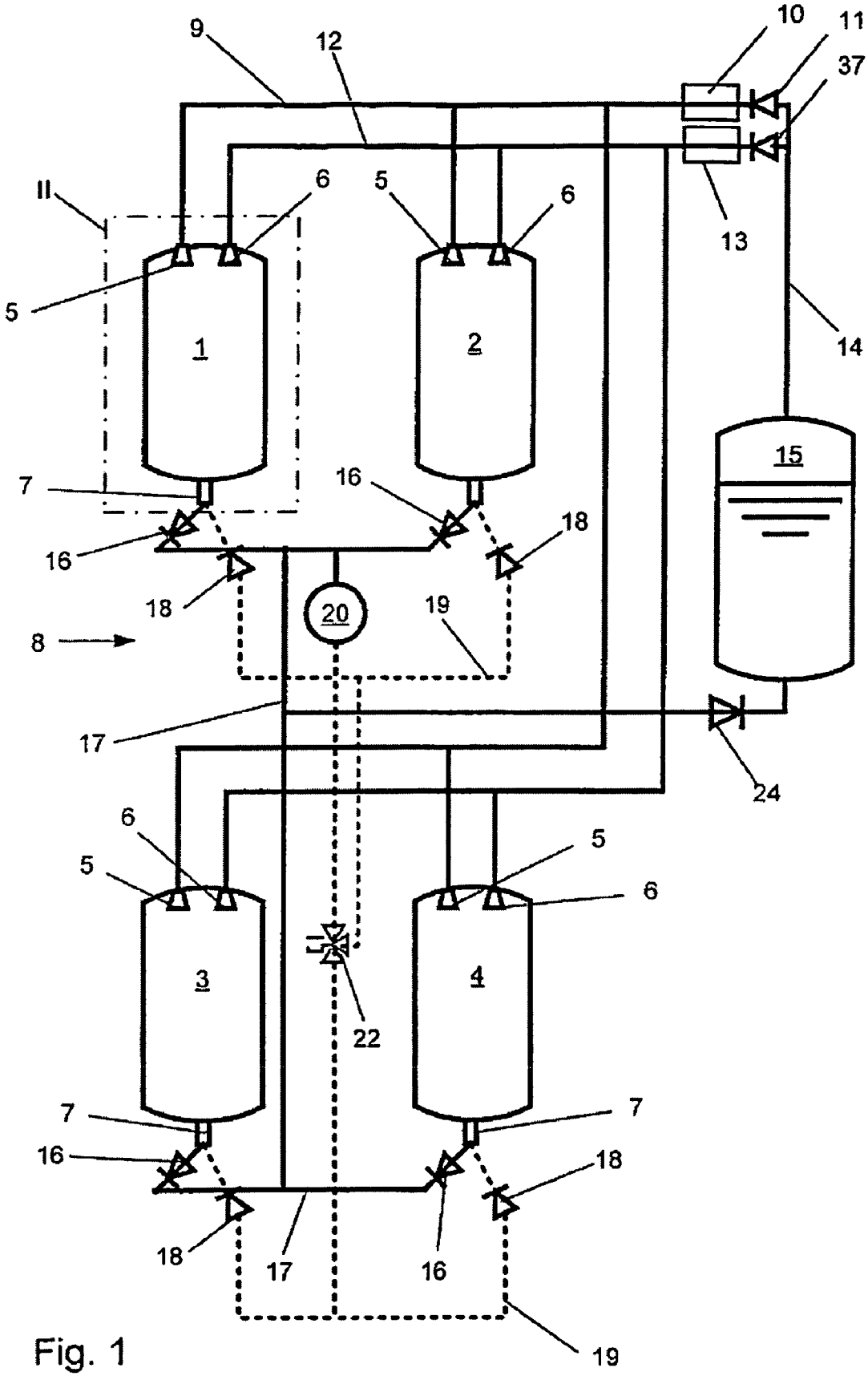

The invention refers to a system for the conversion of thermal to motive energy with at least one pressure vessel, which has at least one upper injection orifice for a warm and/or cold fluid, and with a liquid piston pump within the pressure vessel, coupled with a working cycle.

EP 1 159 512 B1 describes a gas expansion element for a system to convert thermal to motive energy, consisting of a closed pressure vessel, filled with a gas or gas mixture, which is connected to the system effectively via a displaceable piston and has an upper injection orifice for warm water and an upper injection orifice for cold water and a lower water outlet orifice. The lower outlet orifice is located on the lower end of a sump projecting the pressure vessel downwards, which has a substantially smaller diameter than the pressure vessel, and the piston is formed as a liquid piston pump, which is connected on the inlet side to the water outlet orifice of the pressure vessel, with which a water inflow of a working cycle is correlated, and on the outlet side to a water outlet of the working cycle.

Moreover, DE 102 09 998 A1 discloses a gas expansion element for a system for converting thermal to motive energy, consisting of a closed pressure vessel filled with a gas mixture, which is effectively connected to the system via a liquid piston and has an upper injection orifice for warm water and one for cold water and a lower one with a water outlet orifice connected to a working cycle. The liquid piston is provided within the pressure vessel, and a pressure-resistant separation layer, impinged on by the gas or the gas mixture, floats on the pressure-impinged surface of the liquid piston. Such a gas expansion element is also known from U.S. Pat. No. 3,608,311 A1. The liquid piston is connected via an orifice to a forward stroke and a backstroke of a working cycle and to the injection orifices for warm and cold water. These gas expansion elements are disadvantageous in that the gas that expands with the inflow of warm water impinges the liquid piston only insufficiently and a relatively large quantity of heat of the injected warm water is introduced into the liquid piston and thus is no longer available for the expansion of the gas, and for this reason, the system to convert thermal to motive energy has a relatively low efficiency.

It is the goal of the invention to create a system to convert thermal to motive energy of the type mentioned in the beginning.

In accordance with the invention, the goal is attained in that the pressure vessel has a horizontal wall provided with a borehole, wherein a gas or gas mixture is found above the wall and the liquid pump below the wall.

With the horizontal wall, a thermal separation between the gas, impinged on, alternatingly, with a warm or cold fluid, and the liquid piston pump is attained. The borehole hereby forms a type of sump, which reduces an overflow of the gaseous medium into the area of the liquid piston pump and thus reduces heat transfer between the air and the liquid piston, wherein a resulting condensate arrives at the liquid piston through the borehole. Moreover, the local delimitation by the wall ensures a rapid penetration of the gas with the warm or cold fluid for the expansion or the contraction of the air.

Preferably, the borehole expands conically in the direction of the section of the pressure vessel filled with gas. By the conicity of the borehole, which extends close to the wall of the pressure vessel, the collecting and conducting of the condensate from the section of the pressure vessel filled with gas is favored, wherein the borehole acts favorably on the heat transfer between the gas and the liquid piston as a result of its cylindrical part.

According to an advantageous development, a float valve with a borehole for limiting the fill level of the liquid piston pump is inserted into the wall. The float valve opens the borehole during the expansion of the gas in the pressure vessel, so that an impingement of the liquid piston pump takes place, and closes the borehole upon attaining a maximum filling level of the liquid piston pump, so as to prevent an overflowing of the liquid into the area of the pressure vessel filled with gas.

Preferably, the float valve comprises a basket, screwed into the wall, to hold a plastic sphere, wherein the basket comprises the cylindrical part of the borehole. The plastic sphere has a lower density than the liquid of the liquid piston pump and is dimensioned in such a way that it closes the borehole.

In order to protect the plastic sphere of the float valve from thermal damage during a gas impingement with warm fluid, the basket in the conformation has a screen affixed via distance sleeves, which projects into the area of the pressure vessel filled with gas or gas mixture. The screen can, for example, be made of a metal material and prevents the direct impingement of the plastic sphere with the fluid. Moreover, the screen contributes to a distribution of the fluid injected into the pressure vessel, which, accordingly, penetrates relatively quickly into the gas within the pressure vessel.

Appropriately, the pressure vessel has, on his lower end, a connection piece to connect to a flow line of the working cycle. Advantageously, the connection piece is coupled with a backflow of the work cycle. In this combination, in which both the flow line and also the backflow line of the working cycle are connected to the connection piece, the liquid piston or the filling level height within the liquid piston pump can be detected by a relatively simple float switch or limited by the float valve. As an alternative to this, the backflow line of the working cycle, in particular, with the interposition of a controllable valve, is connected to a line leading to the injection orifice for the cold fluid or to a supply vessel for the fluid. The fluid in the backflow line of the working cycle is found at a relatively low temperature level and can be conducted as a cold fluid into the pressure vessel, so as to bring about a contraction of the gas found therein.

In order to convert the translatory movement of the liquid piston pump into a rotatory movement, the flow line leads to a turbine, from which the return line emerges.

For the loading of the feed water cycle and for pressure compensation within the system, the flow line is preferably connected to the supply vessel via a conduit. The filling level of the supply vessel can be regulated with an inserted float valve.

According to another conformation of the invention, a conduit exits from the supply vessel, which, with the interposition of valves, branches off to heating and cooling devices for the fluid. The valves can, for example, be designed as relatively simple check valves, so as to impinge on the gas within the pressure vessel in a pressure-controlled manner with warm or cold fluid alternately, wherein, of course, the placement of a controlled multiway valve is also conceivable. Appropriately, the heating and the cooling devices are respectively coupled with one of the injection orifices with the interposition of a controlled valve.

Preferably, the fluid is water or an organic substance containing pentane, toluene, or silicone oil. Such organic substances are used in power plant operation in the so-called Organic Rankine Cycle (ORC) and have the advantage that under ambient pressure, they evaporate at relatively low temperatures.

For the further increase of the performance of the arrangement, provision is made, in an advantageous refinement of the inventive idea, for a short-circuit pipeline between two pressure vessels with at least a controllable valve for pressure compensation between the pressure vessels after the work of the gas has been performed. At the end of the work phase, a pressure difference prevails between the two pressure vessels, which is caused by the warm gas of one of the pressure vessels and the cold gas of the other pressure vessel. With the pressure compensation, a heat flow takes place, wherein the still present thermal energy in the one pressure vessel is utilized to heat the gas of the other pressure vessel up to a compensation temperature. Simultaneously, the quantity of gas in the pressure vessel increases with the expanding gas, wherein an increase in the pressure difference between the two pressure vessels and thus a performance enhancement also occurs.

It is understandable that the aforementioned features and those below, which have yet to be explained, can be used not only in the indicated combination but rather in other combinations also. The framework of the invention under consideration is defined only by the claims.

Figure 2:
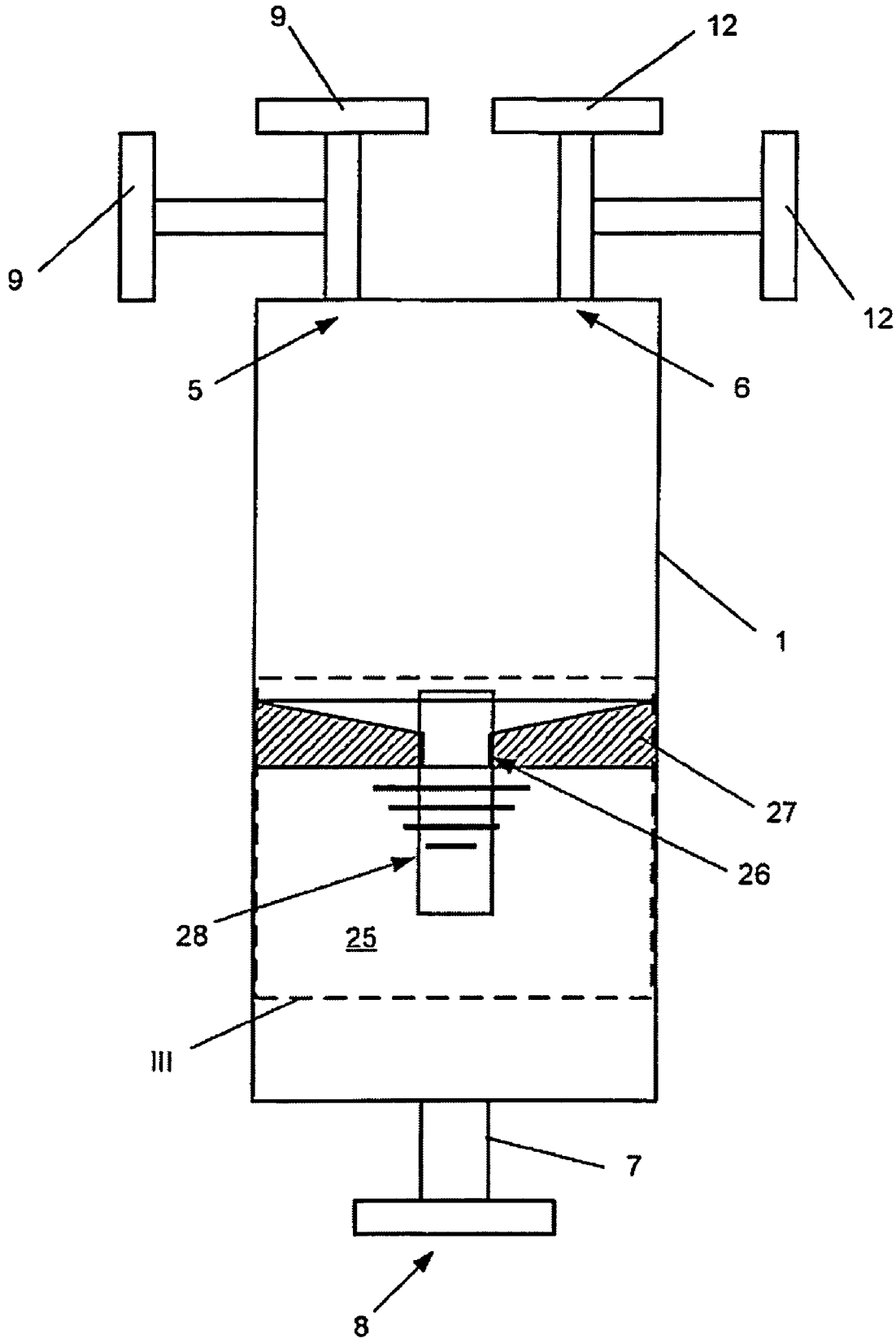
Figure 3:
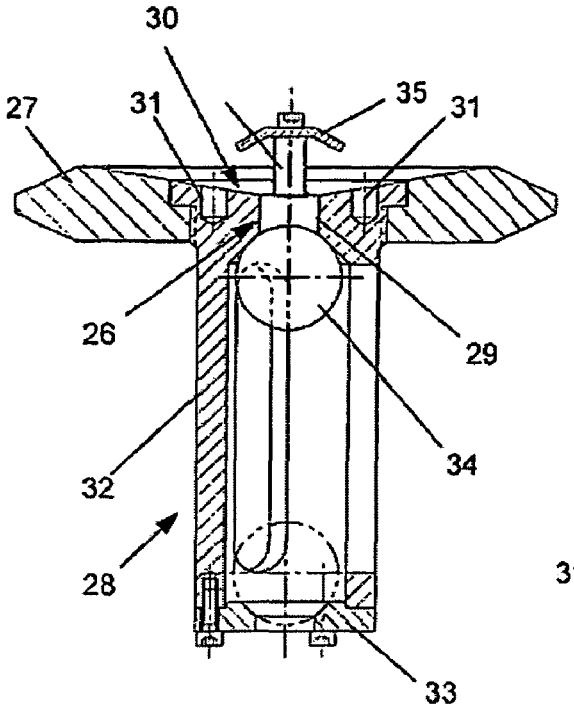
Figure 4:
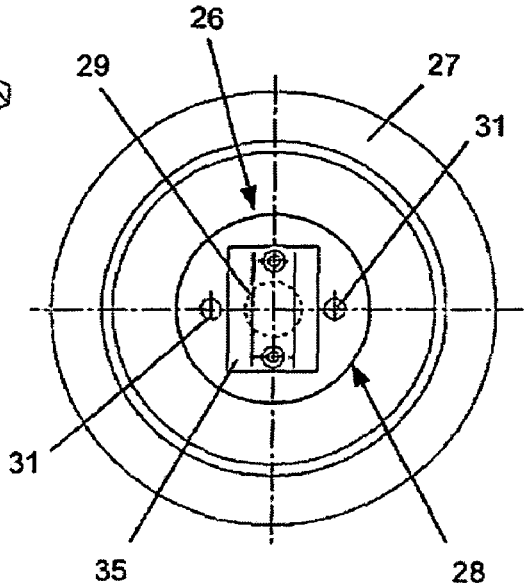

The invention is explained in more detail below with the aid of an exemplified embodiment with reference to the corresponding drawings. The figures show the following:

FIG. 1, a schematic representation of the system, in accordance with the invention, to convert thermal to motive energy;

FIG. 2, an enlarged representation of detail II according to FIG. 1 in partial section;

FIG. 3, an enlarged sectional representation of detail III according to FIG. 2;

FIG. 4, a top view of the representation according to FIG. 3; and

Figure 5:
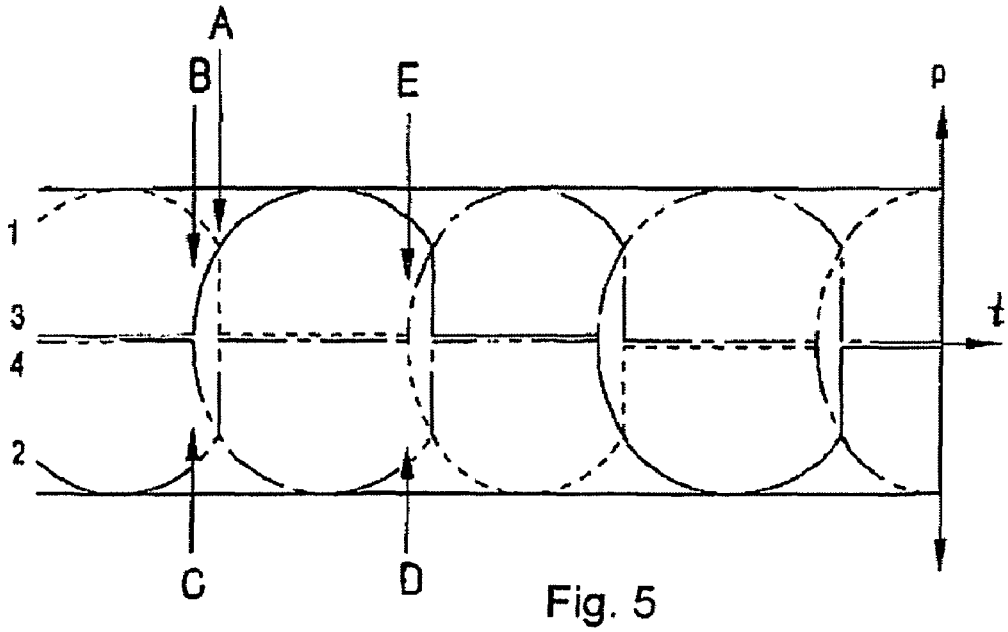

FIG. 5, a schematic representation of a pressure-time diagram of the system according to FIG. 1.

The system comprises four pressure vessels 1, 2, 3, 4, which have an upper injection orifice 5 for warm water and an upper injection orifice 6 for cold water and on their lower ends, a connection piece 7 to connect to a working cycle 8. The injection orifice 5 for warm water is coupled via a conduit 9 with an inserted heating device 10, with a correlated valve 11 constructed as a check valve, which is coupled via a conduit 14 with a supply vessel 15 for the loading cycle, used as an overflow vessel. Moreover, the conduit 14 is connected to the injection orifice 6 for cold water via another valve 37 constructed as a check valve, and via a conduit 12 coupled with a cooling device 13. The connection piece 7 of each pressure vessel 1, 2, 3, 4 discharges, on the one hand, into a flow line 17 with the interposition of a check valve 16, and, on the other hand, into a backflow line 19 of the working cycle 8, which also has a check valve 18, wherein the flow line 17 is coupled both with a turbine 20 and also with the supply vessel 15 with the interposition of a check valve 24. The backflow line 19 connecting the pressure vessels 1, 2, 3, 4, is connected to the turbine, with the interposition of a controllable valve 22 conformed as a two-way valve.

A liquid piston pump 25 coupled with the working cycle 8 is constructed within each pressure vessel 1, 2, 3, 4. Moreover, each pressure vessel 1, 2, 3, 4 has a horizontal wall 27, provided with a borehole 26, wherein above the wall 27, the gas is present and below the wall 27, the liquid piston pump 25. The borehole 26 expands conically within the wall 27 in the direction of the section of the pressure vessel 1, 2, 3, 4, filled with gas, up to the interior wall of the pressure vessel 1, 2, 3, 4, so as to collect resulting condensate and to conduct it to the liquid piston pump 25. A float valve 28 is screwed into the wall 25 [sic; 27], welded into the pressure vessel 1, 2, 3, 4; the float valve projects into the area of the liquid piston pump 25, so as to limit its filling level. The upper front side 30 of the float valve 28 is designed so as to correspond to the conical course of the borehole 26 and closes off flush with it. Moreover, the cylindrical part 29 of the borehole 26 is located centrally in the float valve 28. Two blind holes 31, at a distance from one another, for a screwing tool, are located in the upper front side 30 of the float valve 28. A plastic sphere 34 is placed in a basket 32 of the float valve 28, which is closed with a cover 33; it is used to close the borehole 26 upon reaching a maximum filling level of the liquid piston pump 25. In order to protect the plastic sphere 34 from a thermal load during the injection of warm fluid into the pressure vessel 1, 2, 3, 4, an essentially rectangular screen 35 is screwed via distance sleeves 36 on the upper front side 30 of the float valve 28.

At the beginning of the operation of the system, a pressure compensation between the pressure vessels 1 and 2 initially takes place in a valve-controlled manner, as is symbolized by arrow A in FIG. 3 [sic; 5]. Arrow B points to the timepoint at which warm water is injected into the pressure vessel 3, which brings about an expansion of the gas present in this pressure vessel 3. By means of the expanding gas, the displaceable piston of the liquid piston pump 25 is displaced, which thus performs translatory work, which is supplied to the turbine 20 for conversion into rotatory work via the flow line 17 of the working cycle 8. After the rise in pressure and the corresponding pressure decline in pressure vessel 3 after the piston displacement of the liquid piston pump 25 of the pressure vessel 3, the water which is conducted to the liquid piston pump 25 via the borehole 26 stops. At the same time, as indicated by arrow C, cold water prepared in the cooling device 13 is injected into pressure vessel 4 via the corresponding injection orifice 6. During the injection of the cold water into this pressure vessel 4, the gas contracts and also performs work via the displaceable piston of the corresponding liquid piston pump 25. During this phase, pressure vessels 1, 2 are at a pressure level that corresponds to their compensation pressure. After the transfer of the useful expansion or contraction work of the gas, there is a pressure compensation between pressure vessels 3, 4, wherein, at the same time, cold water is introduced into pressure vessel 1 and warm water into pressure vessel 2, so that their correlated liquid piston pumps 25 perform contraction or expansion work. The timepoint of the injection of cold water into pressure vessel 1 is shown by arrow D and that of the injection of warm water into pressure vessel 2 by arrow E.

The controllable valve 22 in the backflow line 19 is connected in such a way that it prevents water from arriving at pressure vessels 1, 2, 3, 4, as long as a pressure compensation prevails respectively between two pressure vessels 1, 2, 3, 4.

The invention claimed is:

1. A system to convert thermal into motive energy comprising at least one pressure vessel, including at least one upper injection orifice for a fluid that is warm or cold, and a liquid piston pump within the at least one pressure vessel that is coupled with a working cycle, wherein the pressure vessel has a horizontal wall provided with a borehole, further wherein above the wall there is a gas or gas mixture and the liquid piston pump is below the wall, and further wherein the float valve comprises a basket screwed into the wall to receive a plastic sphere, wherein the basket has a cylindrical part of the borehole.

2. The system according to claim 1, wherein the borehole expands conically in the direction of the section of the pressure vessel filled with gas.

3. The system according to claim 1, wherein a float valve with a borehole for limiting a fill level of the liquid piston pump is inserted into the wall.

4. The system according to claim 1, wherein the basket carries a screen affixed via distance sleeves, which screen projects into the area of the pressure vessel filled with gas or a gas mixture.

5. The system according to claim 1, wherein the pressure vessel has on its lower end a connection piece to connect to a flow line of the working cycle.

6. The system according to claim 5, wherein the connection piece is coupled with a backflow line of the working cycle.

7. The system according to claim 6, wherein the backflow line of the working cycle is connected with interposition of a controllable valve to a conduit leading to the injection orifice for the cold fluid or to a supply vessel for the fluid.

8. The system according to claim 6, wherein the flow line leads to a turbine, from which the backflow line exits.

9. The system according to claim 7, wherein the flow line is connected to the supply vessel via a conduit.

10. The system according to claim 9, wherein a conduit exits from the supply vessel, and the conduit branches off with the interposition of valves to a heating and cooling device for the fluid.

11. The system according to claim 10, wherein the heating device and the cooling device are respectively coupled with one of the injection orifices with the interposition of a controlled valve.

12. The system according to claim 1, wherein the fluid is water or an organic substance including pentane, toluene, or silicone oil.

13. The system according to claim 1, wherein a short-circuit pipeline with at least one controllable valve for pressure compensation between the pressure vessels is respectively provided between two of the pressure vessels after the performance of the work of the gas.

* * * * *